United States Patent [19]

Hansen et al.

[11] 4,393,684

[45] Jul. 19, 1983

[54] PRESS HAVING A LINKAGE MECHANISM CONNECTABLE AND DISCONNECTABLE FROM A RAM

[75] Inventors: David M. Hansen, Dublin; Richard B. Ernest, Richboro, both of Pa.

[73] Assignee: Penn Engineering & Manufacturing Corp., Danboro, Pa.

[21] Appl. No.: 233,942

[22] Filed: Feb. 12, 1981

[51] Int. Cl.[3] ..... B21J 9/18

[52] U.S. Cl. ..... 72/451; 72/453.19

[58] Field of Search ..... 72/451, 453.01, 453.02, 72/453.03, 453.18, 391, 453.19; 227/129, 1; 29/243.53

[56] References Cited

U.S. PATENT DOCUMENTS

| | | | |
|---|---|---|---|
| 1,684,296 | 9/1928 | Brodsky . | |
| 2,767,819 | 10/1956 | Cullerton . | |
| 3,222,913 | 12/1965 | Leopold | 72/429 |
| 3,465,410 | 9/1969 | Ernest | 29/713 |
| 3,518,869 | 7/1970 | Forichon | 72/451 |
| 3,926,033 | 12/1975 | Forichon | 72/451 |
| 3,939,314 | 2/1976 | Loeser . | |
| 3,955,739 | 5/1976 | Markus | 227/1 |
| 4,044,445 | 8/1977 | Douri | 29/706 |

FOREIGN PATENT DOCUMENTS

| | | | |
|---|---|---|---|
| 482226 | 4/1952 | Canada . | |
| 1030433 | 5/1966 | United Kingdom . | |
| 1296140 | 11/1972 | United Kingdom . | |
| 2028951 | 2/1980 | United Kingdom . | |
| 2028696 | 3/1980 | United Kingdom | 72/453.03 |

*Primary Examiner*—Gene Crosby

*Attorney, Agent, or Firm*—Joseph G. Denny, III; Peter J. Patane

[57] ABSTRACT

A press for assembling a fastener or the like to a plate or the like comprises a frame and an anvil assembly carried by said frame. A toggle mechanism assembly is carried by the frame and includes two toggle links. A ram is operatively connectable to the toggle links. A first pneumatic cylinder and piston assembly holds the ram in a raised position. A first pneumatic switch terminates the flow of pressurized air to the first pneumatic cylinder, thereby permitting the ram to drop by gravity. A second pneumatic switch is activated after a sufficient drop of said piston to energize a second pneumatic cylinder and piston assembly for extending and retracting said toggle links, and thereby forcefully lower the ram to install the fastener or the like to a plate or the like.

9 Claims, 7 Drawing Figures

PRESS HAVING A LINKAGE MECHANISM CONNECTABLE AND DISCONNECTABLE FROM A RAM

BACKGROUND OF THE INVENTION

This invention relates to presses of the type for installing fasteners or the like into sheeted plates. A press of this type is disclosed in U.S. Pat. No. 3,465,410 among others.

SUMMARY OF THE INVENTION

It is an object of this invention to provide a press for installing fasteners or the like which is simpler and less expensive to manufacture than certain other presses heretofore known.

It is a further object of this invention to provide a press with a point of operation safety device incorporated in the press.

It is still another object of this invention to provide a press which is entirely actuated by pneumatic power.

A still further object is to provide a unitary operating mechanism which can be added to or removed from the frame as one unit to facilitate its assembly, testing and repair, if necessary.

The press provided by this invention comprises a frame and an anvil assembly carried by the frame. A toggle mechanism assembly is carried by the frame and includes two toggle links. A ram is operatively connectable to the toggle links, and pneumatic means are provided for retracting and extending the toggle links. The pneumatic means includes a first pneumatic cylinder and piston assembly for holding the ram in a raised position. Also provided is first pneumatic switch means for terminating the flow of pressurized air to the first pneumatic cylinder, thereby permitting the said ram to drop by gravity. A second pneumatic switch means is activated after a sufficient descent of the ram to energize a second pneumatic cylinder and piston assembly for extending and retracting the toggle links, and applying to the ram a sufficient force to thereby install a fastener or the like to a plate or the like.

BRIEF DESCRIPTION OF THE VIEWS

DESCRIPTION OF THE PREFERRED EMBODIMENT

Figure 1:
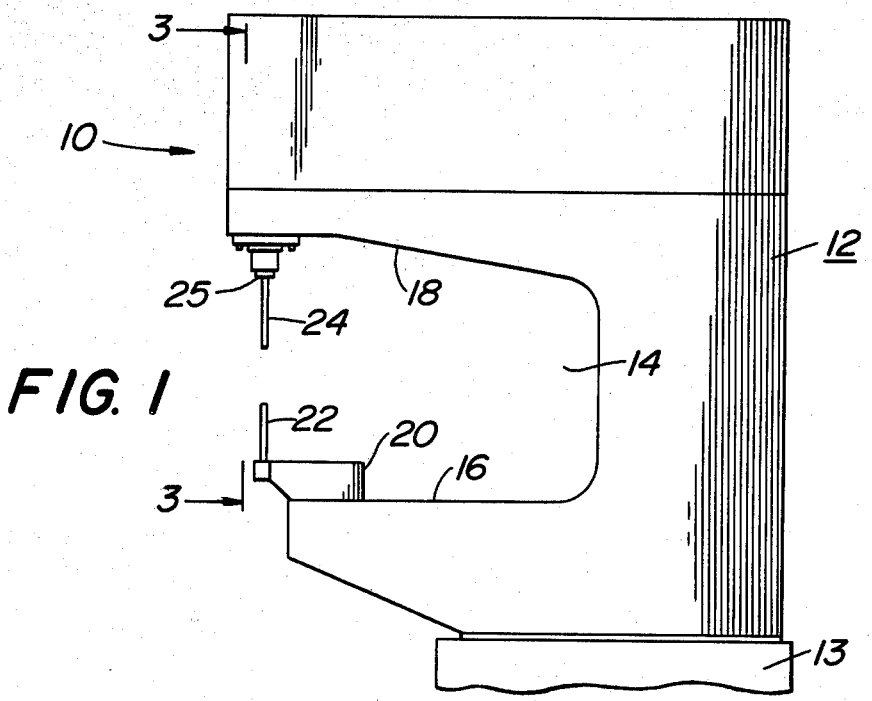
FIG. 1 is a side elevation of the pneumatically operated press embodying this invention.

Referring to the drawings, FIG. 1 is a side elevation view illustrating the pneumatically operated press 10 of this invention. The press 10 comprises a frame 12 secured to a suitable base 13. The frame 12 defines a throat 14 between a jaw 16 and a roof 18. Secured to the jaw 16 is an anvil holder 20 supporting an anvil 22. Positioned vertically above the anvil 22 is a punch 24 carried by a punch holder 25 which is lowered and raised by a toggle mechanism assembly 26, FIG. 2, to thereby attach a fastener 28 or the like to a plate 30 resting upon the anvil 22, FIG. 5.

Figure 2:
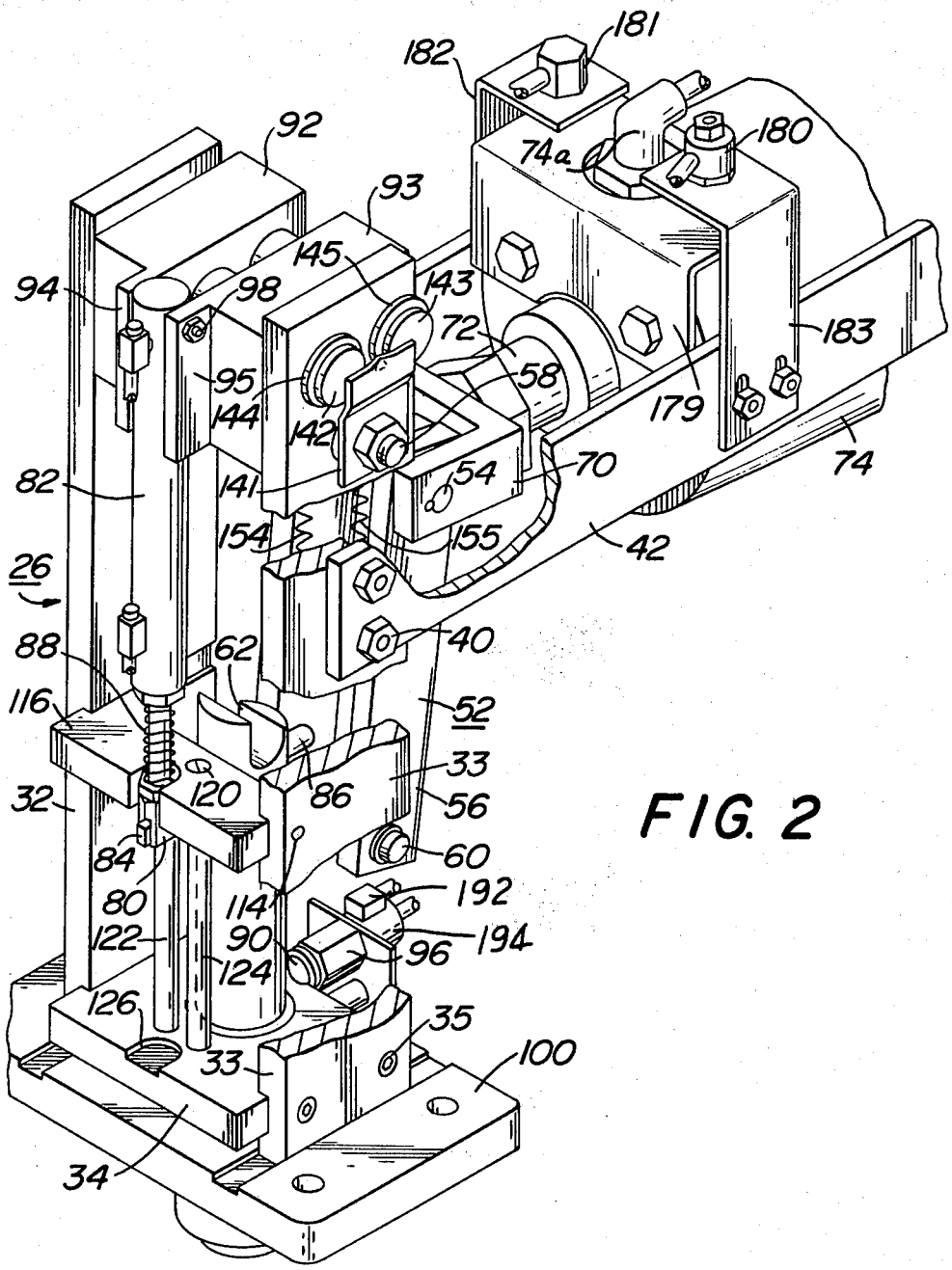
FIG. 2 is a top and side perspective view of the toggle mechanism assembly of the press shown in FIG. 1.
Figure 3:
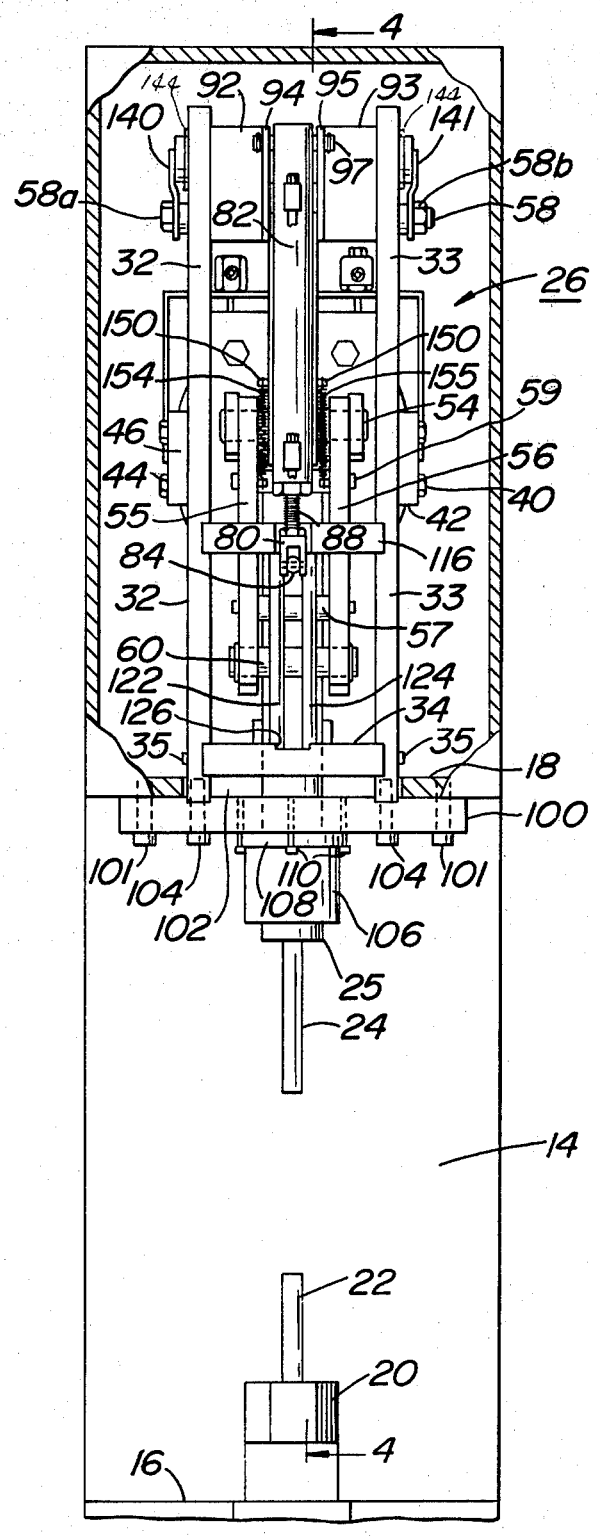
FIG. 3 is a sectional view taken along the line 3—3 in FIG. 1, showing a portion of the press in front elevation.

The toggle mechanism assembly 26 comprises two vertically extending plates 32 and 33 spaced apart at the bottom, as shown in FIGS. 2 and 3, by a spacer 34 to which they are secured by suitable screws 35.

Secured to the vertical plate 33 by suitable bolts 40 and extending backwardly, FIG. 2, is a horizontal plate 42. Similarly, secured to the vertical plate 32 by suitable bolts 44 is a horizontal plate 46, FIGS. 3, 4 and 5.

Figure 4:
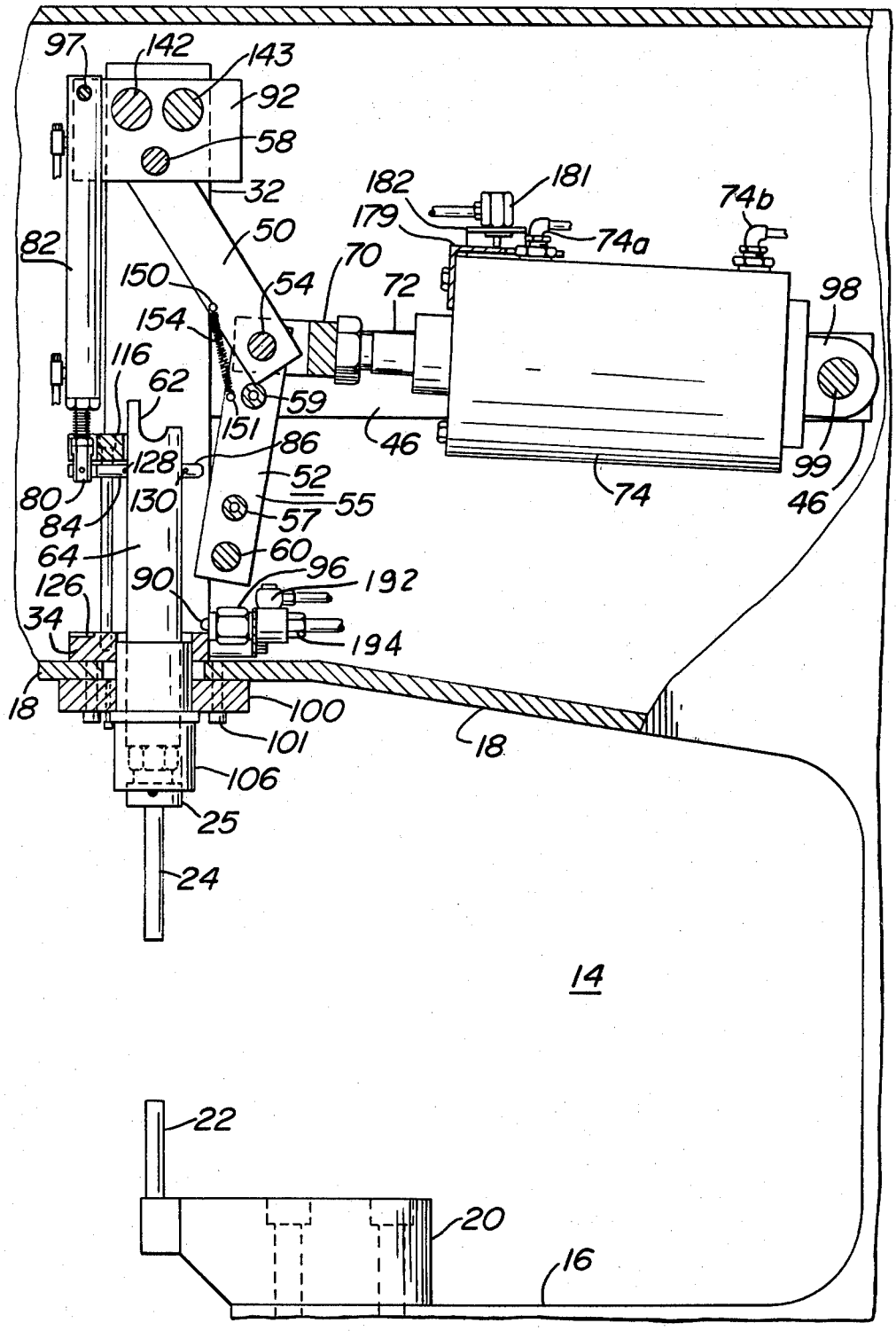
FIG. 4 is a sectional view taken along the line 4—4 in FIG. 3, showing a portion of the press in side elevation and also showing the toggle links in the fully retracted position.

Disposed intermediate the vertical plates 32 and 33 and the horizontal plates 42 and 46 are an upper toggle link 50 and a lower toggle link 52 pivotally connected together by a pin 54, the lower toggle link 52 being formed by spaced apart plates 55 and 56, as shown in FIG. 3, the plates 55 and 56 being spaced apart by spacers 57 and 59, FIGS. 3 and 4. The upper toggle link 50 is pivotally secured at its upper portion to the vertical plates 32 and 33 by a pin 58.

Figure 5:
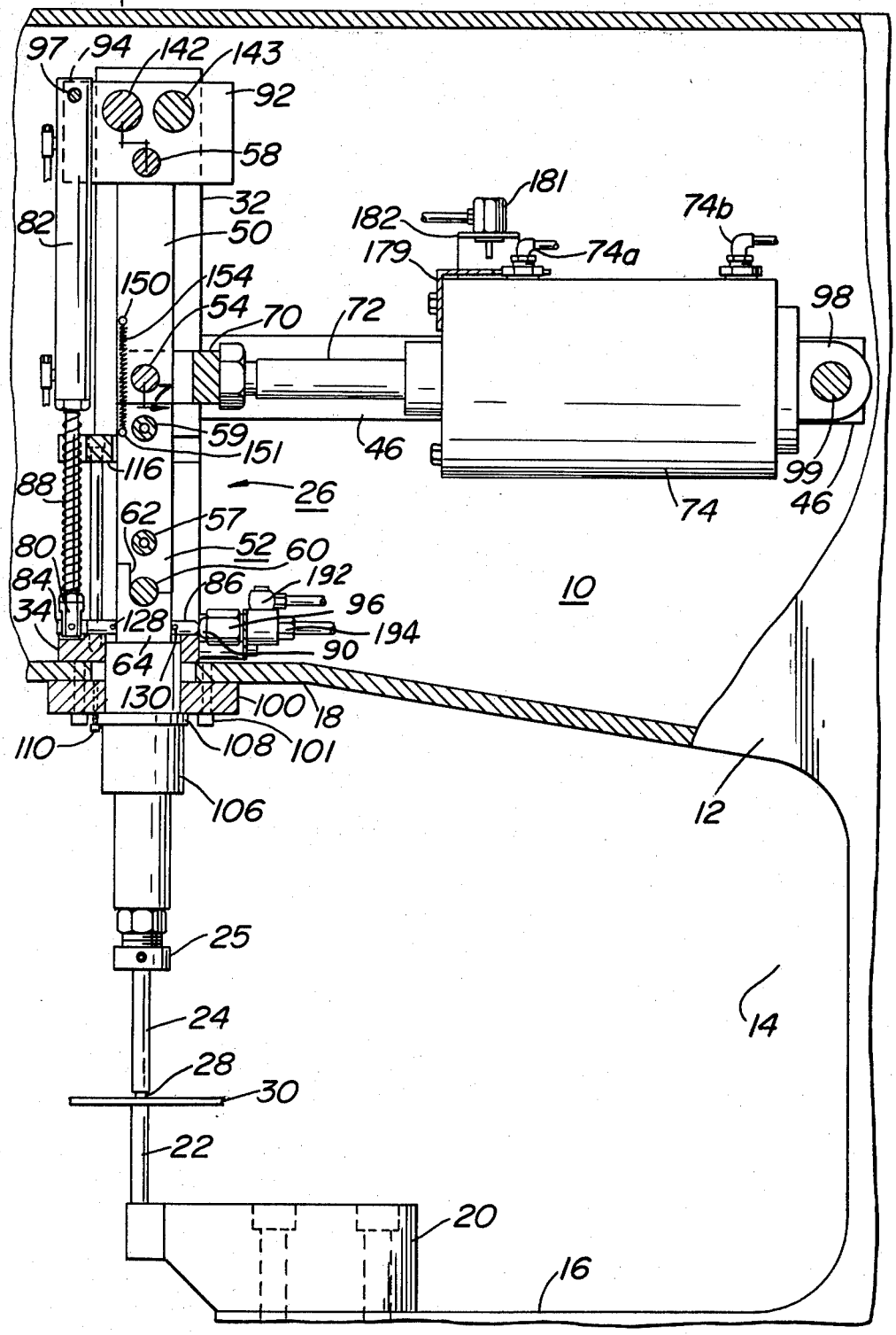
FIG. 5 is a sectional view similar to FIG. 4 but showing the fully extended position of the toggle links and a plate upon the anvil with a fastener secured to the plate by the punch.

The lower toggle link 52 carries a pin 60 between the plates 55 and 56 at the lower ends thereof, as shown in FIGS. 3 and 5. The pin 60 is received in an open ended notch 62 in the upper end of a ram 64, the ram 64 having secured to it at its lower end the punch holder 25 carrying the punch 24.

The toggle links 50 and 52 are retracted to the position shown in FIG. 4 and extended to the position shown in FIG. 5 by a clevis 70 carrying the opposite ends of the pin 54 and which is also connected to a rod 72. The rod 72 extends into a pneumatic cylinder 74 having a piston (not shown) which is actuated by the introduction of suitably pressurized air through fittings **74*a* and 74*b*, FIGS. 4 and 5, to one side or the other of the piston, as is well known. When the rod 72 moves back and forth, it causes the upper toggle link 50 to pivot about the pin 58, carrying the lower toggle link 52** along also.

As best shown in FIG. 4, when the toggle links 50 and 52 are in the fully retracted position, the lower toggle link 52 is disjoined from the ram 64, that is, the pin 60 of the lower toggle link 52 is out of the notch 62 and behind the ram 64. Thus, at such time there is no operative connection between the ram 64 and the rod 72.

Movement of the ram 64 downwardly to a position where it may be engaged by the pin 60 is controlled by a rod 80 extending from a pneumatic cylinder 82, the rod 80 being connected to the upper end portion of the ram 64 by an arm 84, extending into a suitable hole in the ram 64 and having a nose 86 protruding to the right, as shown in FIG. 4. The rod 80 is connected to a piston (not shown) disposed within the cylinder 82 and during the steady state condition, i.e., immediately before a cycle starts, suitably pressurized air is admitted into the cylinder 82 to hold the piston in its raised or upper position so that the rod 80 is kept raised, as shown in FIG. 4. When a cycle of the press 10 is started, the supply of air to the cylinder 82 is terminated, as hereinafter specified, and the air within the cylinder 82 is exhausted, causing the piston within cylinder 82, the rod 80 and the ram 64 to all drop by gravity, but to assure the descent of the rod 80 a spring 88 may be placed around the rod 80 biased against the cylinder 82, as shown in FIG. 4.

As best shown in FIG. 2, spacers 92 and 93 are provided between the vertical plates 32 and 33 on either side of the upper toggle link 50. The spacers 92 and 93 include spaced flanges 94 and 95 between which is disposed the cylinder 82 and to which the cylinder 82 is secured by a suitable bolt 97.

When the flow of pressurized air to the cylinder 82 is terminated and the air within it is exhausted, the rod 80 and the arm 84 will descend from the position of FIG. 4 to that of FIG. 5. When the nose 86 reaches the position of FIG. 5, it will depress a ball 90 of a ball valve 96 to permit pressurized air to flow into a pneumatic timer 168 and a four way pilot valve 170, FIG. 6, and thereafter flow into the cylinder 74, thereby extending the rod 72 from the position shown in FIG. 4 to the position shown in FIG. 5.

As illustrated in FIGS. 4 and 5, the cylinder 74 includes an ear 98 through which extends a pin 99 for pivotally securing the cylinder 74 to the right hand end portions of the horizontal plates 42 and 46. Thus, as the rod 72 extends and retracts, it pivots the upper toggle link 50 about the pin 58 and the cylinder 74 pivots about the pin 99.

The pin is slidably supported in suitable holes in the vertical plates 32 and 33 and the spacers 92 and 93. Endwise movement of the pin 58 is prevented by a head **58*a* at the left, FIG. 3, and a nut 58*b* threaded on the right hand end of the pin 58. Spacers 58*c* and 58*d* are provided between the head 58*a* and the plate 32 and between the nut 58*b* and the plate 33, respectively, FIG. 7. The pin 99 is similarly retained on the horizontal plates 42 and 46, but its head and nut are not shown in the drawings. This slidable support of pins 58 and 99 permits them to rotate, as necessary, when forces are applied to the pins 58 and 99 during the operation of the press 10**.

A horizontal plate 100 is secured by suitable bolts 101 to the roof 18 of the frame 12. The roof 18 has a suitable hole 102 into which extend the lower portions of the vertical plates 32 and 33, as shown in FIG. 3. The lower ends of the vertical plates 32 and 33 are secured to the horizontal plate 100 by suitable bolts 104. Thus, the forces imposed by the toggle links 50 and 52 on the vertical plates 32 and 33 are transferred to the frame 12 at the plate 100.

The horizontal plate 100 has a hole into which extends a bearing 106. The bearing 106 has a collar 108 disposed below and abutting the horizontal plate 100 and secured thereto by bolts 110, so that the bearing 106 may be removed by unscrewing the bolts 110 and sliding it downwardly into the throat 14 of the press 10 until the bearing 106 clears the plate 100. If desired, a retaining plate, not shown, may be substituted for the bolts 110.

Secured to the vertical plates 32 and 33 by suitable screws 114 is a horizontal support bracket 116. Secured to the horizontal support bracket 116 by set screws 120 are vertical guide rods 122 and 124 spaced from each other as shown in FIGS. 2 and 3. Received between the guide rods 122 and 124 is the arm 84 which is free to travel up and down between the guide rods 122 and 124 but is kept from pivoting in a horizontal plane by the guide rods 122 and 124. To permit the arm 84 to rest flat against the lower base 34 in its lowermost position, as shown in FIG. 5, and thereby limit its downward travel, the base 34 is recessed as at 126 to receive the lower portion of the rod 80 (which extends from the cylinder 82).

The arm 84 is shown as extending through a suitable hole in the ram 64. To secure the arm 84 to the ram 64, roll pins 128 and 130 extend through the arm 84 on either side of the ram 64, as shown in FIGS. 4 and 5. The arm 84 could be welded to the ram 64, but by using the roll pins 128 and 130 removal of the arm 84 when necessary is facilitated.

Figure 7:
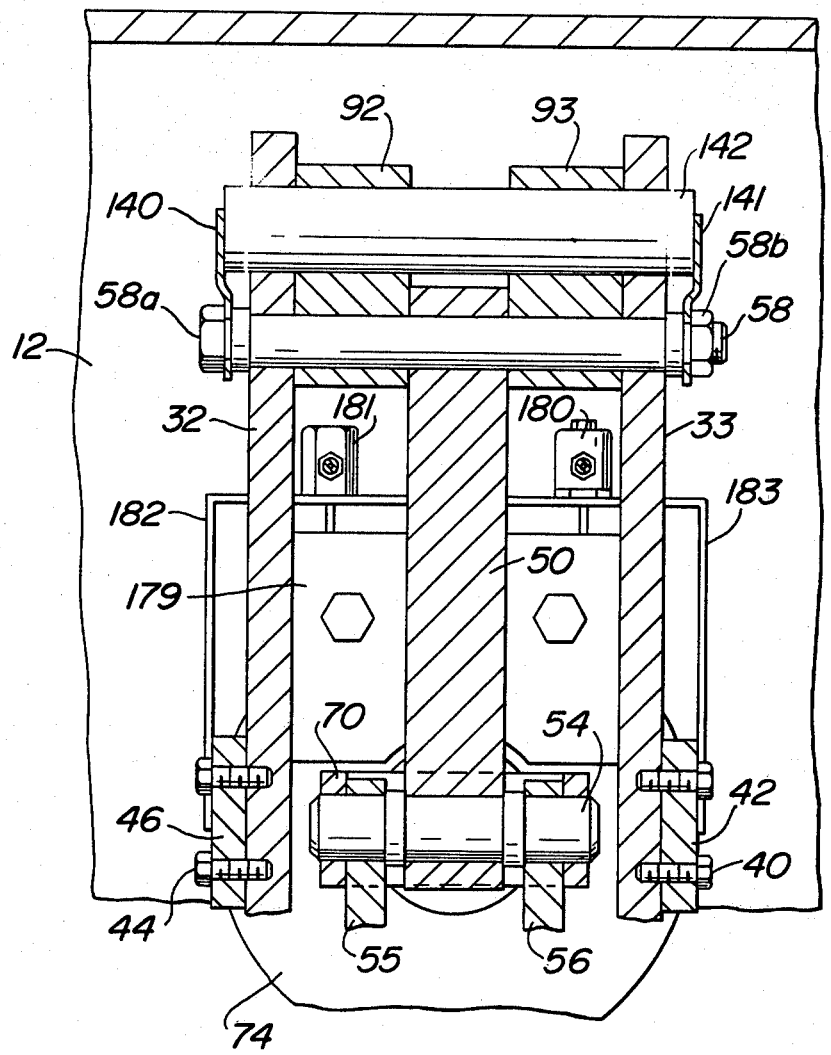
FIG. 7 is a sectional view taken along the line 7—7 in FIG. 5.

As shown in FIGS. 2, 3, 4 and 5, the upper spacers 92 and 93 are also carried by dowel pins 142 and 143 which extend through the spacers 92 and 93 through the vertical plates 32 and 33. Clips 144 and 145 are secured to the ends of the dowel pins 142 and 143 which extend beyond the vertical plates 32 and 33 to temporarily secure the various parts to each other during assembly. Clips 140 and 141 are carried by the pin 58 as shown in FIGS. 3 and 7, to restrain longitudinal movement of the pins 142 and 143.

As the toggle links 50 and 52 straighten, a force is exerted upwardly on the pin 58. The pin 58 deflects upwardly and bears against the spacers 92 and 93, transferring the force to the pins 142 and 143. Since the pins 58, 142 and 143 are supported at their ends by the vertical plates 32 and 33, the force is therefore transferred to the plates 32 and 33 and through them and the plate 100 to the roof 18 of the frame 12.

When the rod 72 retracts to the position shown in FIG. 4, two tension springs 154 and 155 which extend between posts 150 and 151 help to lift the pin 60 out of the ram 64 by pivoting the lower toggle link 52 clockwise while the rod 72 and toggle links 50 and 52 are moving to the right. Counterclockwise movement of lower toggle link 52 under influence of the springs 154 and 155 is limited by abutment of the lower left hand corner of upper toggle link 50 with the outer surface of spacer 59, as shown in FIG. 4.

Figure 6:
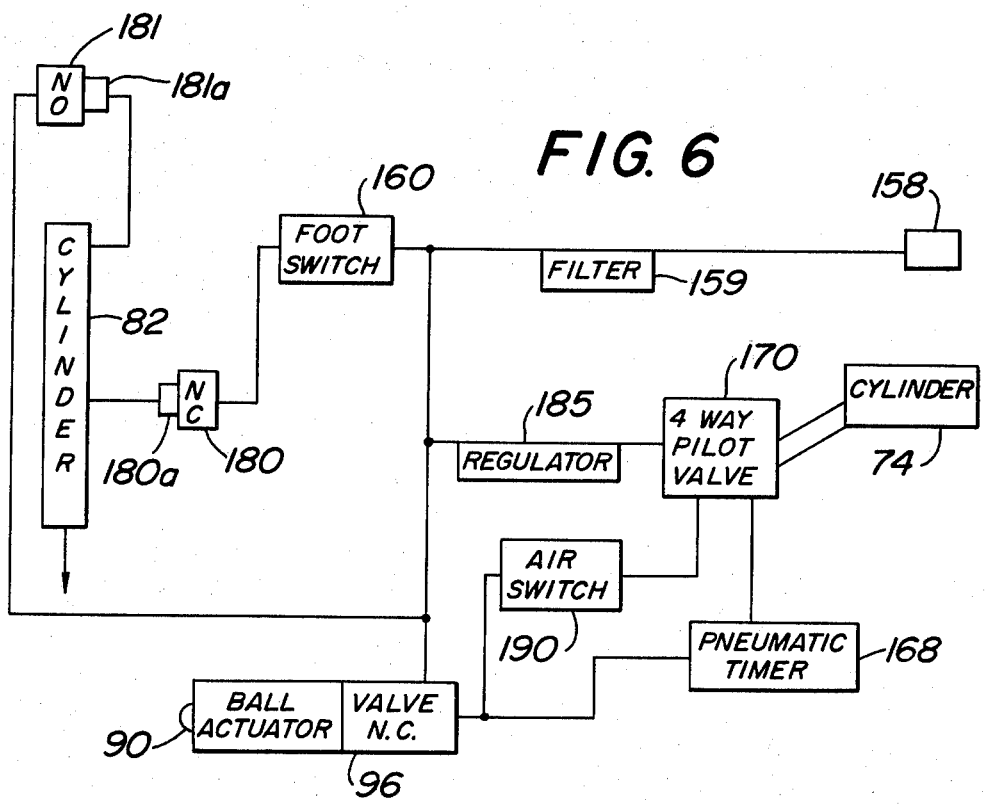
FIG. 6 is a diagrammatic view of the pneumatic circuit of the press.

FIG. 6 illustrates diagrammatically the pneumatic circuit for controlling the press 10, the circuit being connected to a suitable source 158 of pressurized air and a suitable filter 159 therefor. The pneumatic circuit includes a foot operated switch valve 160 which is depressed by the operator when it is desired to start a cycle. The foot switch valve 160 is normally open so that when the foot switch valve 160 is depressed it closes, terminating the flow of pressurized air to the cylinder 82 and simultaneously exhausts the pressurized air within the cylinder 82 out through a suitable port of the foot switch valve 160.

Since no air is then supplied to the cylinder 82 and the air already within it is thus exhausted, the piston within the cylinder 82 starts to descend by gravity and because of the connection between the ram 64 and the rod 80 by virtue of the arm 84, the ram 64 and punch holder 25 also descend by gravity.

When the arm 84 descends sufficiently its righthandmost portion, as viewed in FIGS. 4 and 5, will engage and depress the ball 90 of the ball valve 96, opening the latter. When the ball valve 96 is so opened, it permits pressurized air to flow into the pneumatic timer 168.

Prior to the initiation of the cycle by depressing the foot switch 160, it is seen by reference to FIG. 6 that pressurized air is supplied through the regulator 185 and the four-way valve 170 to the cylinder 74. At such time, pressure is supplied to the piston within the cylinder 74 to keep the piston retracted, i.e., at its righthandmost position, as viewed in FIG. 4, so that the rod 72 and the clevis 70 are moved to their rightmost position, whereby the pin 54 is moved to the rightmost position, collapsing the toggle links 50 and 52 to the position shown in FIG. 4.

The pneumatic timer 168 signals the four-way valve 170 to simultaneously exhaust the pressurized air from the left hand end of the cylinder 74 and to supply suitably pressurized air to the right hand end of the cylinder 74, as viewed in FIGS. 4 and 5, causing the rod 72, clevis 70 and pin 54 all to move to the left and thereby straighten the toggle links 50 and 52 as they move to the left, pivoting about the upper pin 58, to almost a vertical position.

Such movement of the lower toggle link 52 to the left will also lower the pin 60 and will bring the pin 60 into engagement with the vertically upstanding wall defining part of the notch 62 in the ram 64 and continued movement of the rod 72 to the left, as viewed in FIG. 4, will straighten the toggle links 50 and 52 and thereby force the pin 60 down into the notch 62 pressing forcefully upon the ram 64 to thereby exert the force required on the punch holder 25 and punch 24 to squeeze the fastener 28 into the plate 30. It will be noted that at such time the toggle mechanism 26 is effectively operatively connected or joined to the ram 64 and the punch holder 25.

The pneumatic timer 168 is adjustable so that the time period that pressurized air is supplied to the right hand end of the cylinder 74 for the purpose of straightening the toggle links 50 and 52 may be varied as desired to assure a sufficiently long period of time during which the squeezing force is applied between the punch 24 and the anvil 22. However, the amount of force which is exerted downwardly by the toggle links 50 and 52 is determined by the air pressure setting of the air regulator 185.

At the end of the predetermined time period the timer 168 signals the four-way valve 170 to reverse the flow of pressurized air to the cylinder 74 at which time the air is exhausted from the right hand end of the cylinder 74 and pressurized air is supplied to the left hand end of the cylinder 74, whereby the rod 72, clevis 70 and pin 54 are all caused to move to the right, lifting the pin 60 from the notch 62 to disjoin the toggle mechanism from the ram 64 and punch holder 25.

When the rod 72 retracts, that is, moves to the right, as viewed in FIG. 4, the upper toggle link 50 pivots counterclockwise about the fixed pin 58 and the cylinder 74 pivots clockwise about the fixed pin 99. When the cylinder 74 pivots sufficiently clockwise, a bracket 179 secured to the left hand end of the cylinder 74 activates valves 180 and 181 which are carried by straps 182 and 183 secured to the horizontal plates 46 and 42, respectively.

Such actuation of the valves 180 and 181 causes the valve 180 to open and the valve 181 to close. The opening of the valve 180 permits pressurized air to flow into the cylinder 82 causing the rod 80 to raise and thereby also causing the ram 64 to raise and return to the position shown in FIGS. 2, 3 and 4. It will be understood that the raising of the rod 80 takes place after the toggle links 50 and 52 have been retracted (to the right as viewed in FIG. 4) enough to permit the ram 64 to move upwardly without impinging on the pin 60 or the lower toggle link 52.

When the press is at rest but ready to start a cycle, the bracket 179 keeps the valves 180 and 181 actuated so that the valve 180 is open and the valve 181 is closed at such time. After the rod 72 of the cylinder 74 starts moving to the left (FIG. 5), the valves 180 and 181 are released by the bracket 179, because the cylinder 74 pivots down, counterclockwise as viewed in FIG. 5, whereupon the valve 180 automatically closes and the valve 181 automatically opens, since the valves 180 and 181 are spring biased to the closed and open positions respectively.

Referring to FIG. 6, when the press 10 is ready to begin a cycle, it is seen that pressurized air from the suitable source 158 flows through the filter 159 and to the foot switch valve 160, through the valve 180 (which is open at this time) to the cylinder 82 to raise the rod 80 (FIGS. 2 and 4), the valve 181 being closed at this time. The line pressure from the source 158 may be, for example, between 80 to 125 psi.

Pressurized air from the source 158 is also supplied, as shown in FIG. 6, to the pressured regulator 185 which reduces the air pressure to desired levels and also to the ball valve 96 through the fitting 192, FIG. 4. The pressurized air from the regulator 185 flows into and through the four-way valve 170 to the cylinder 74. The operation of the four-way valve 170 is timed by the pneumatic timer 168 which receives pressurized air through the ball valve 96. Thus, by varying the pressure of the air at the regulator 185, the force developed at the rod 72 is varied accordingly and the duration of time of the force is controlled by the timer 168.

When it is desired to set up the press 10 for proper operation, it is necessary to maintain the toggle links 50 and 52 extended, the position shown in FIG. 5. For this purpose a manually operable air switch 190 is provided, as shown in FIG. 6, between the ball valve 96 and the four-way pilot valve 170 to by-pass the pneumatic timer 168. With the ball actuator 90 depressed by the nose 86, thus opening the ball valve 96, the air switch 190 is manually opened and pressurized air is then supplied from the fitting 194, FIG. 4, through the air switch 190 to the four-way valve 170 and to the cylinder 74, FIG. 6, whereby the rod 72 is extended to the left (FIG. 5). It is understood, however, that when pressurized air is supplied to the cylinder 74 because of the opening of the air switch 190 after actuation of the ball 90 of the valve 96 by the nose 86, the cylinder 74 pivots about the pin 99 and the valves 180 and 181 are released, causing the valve 180 to close and the valve 181 to open.

If desired, flow control valves 180*a* and 181*a* may be added alongside the valves 180 and 181 in the lines leading to the cylinder 82. The flow control valves 180*a* and 181*a* restrict the exhausting of the air through the valves 180 and 181 so that the piston within the cylinder 82 is cushioned in either its upward or downward movements which tends to increase the life of the cylinder 82 and its piston and which also tends to eliminate any bounce of the punch 24 during installation of a fastener.

From the foregoing it is seen that when no air is supplied to the cylinder 82 and the air already within it is exhausted, the piston within the cylinder 82 descends by gravity. Because of the connection between the ram 64 and the rod 80, the ram 64, the punch holder 25 and the punch 24 also descend by gravity.

If such descent is interrupted by an obstruction between the punch 24 and the fastener 28, FIG. 5, such as a hand or a finger, the nose 86 is kept from descending sufficiently to actuate the ball 90 of the valve 96 for the purpose of energizing the cylinder 74 and through the toggle links 50 and 52 exerting a sufficient force on the ram 64, punch holder 25 and punch 24 for the purpose of installing the fastener 28 into the plate 30.

Thus, a safety feature has been incorporated into the press at the point of operation, i.e., at the punch 24. So long as the punch 24 is obstructed or prevented from travelling down until it is almost into contact with the fastener 28, the ball 90 of the valve 96 will not be activated and the only force on the obstructing hand or finger will be the weight of the rod 80, arm 84, ram 64, punch holder 25 and punch 24 and the slight spring force of spring 88, all of which is insufficient to cause material injury to the hand or finger.

In one embodiment the distance between the point at which the nose 86 first engages the ball 90 and activates the valve 96 and the point where the arm 84 comes to rest against the base 34 is about 7/32 of an inch. The punch 24 and anvil 22 are adjusted accordingly so that the leading edge of the punch 24 will be about 7/32 of an inch from the plate 30, when the nose 86 first engages the ball 90. It is seen that 7/32 of an inch is less than the thickness of an adult hand or finger so that, if a hand or finger is interposed between the punch 24 and the fastener 28, the ball 90 will not be actuated and the power stroke of the press will not be started so that the risk of injury is minimal. During this 7/32 of an inch movement the nose 86 remains in contact with the ball 90 to keep the valve 96 actuated, that is, opened, so that pressurized air is supplied at such time to the cylinder 74.

While 7/32 of an inch has been given as an example of the distance between the actuation of the ball 90 and the final travel of the ram 64, it will be understood that this distance may be increased or decreased, as may be required.

The rod 72 exerts a force upon the pin 54 to extend the toggle links 50 and 52 and this force is transferred to the ram 64 by the pin 60 seated in the notch 62 to provide the power stroke or high force at the punch 24 necessary to install the fastener 28 to the plate 30. The duration of time of this force or power stroke is controlled by the timer 168 and the operator has no control over the duration of the power stroke so that the operator cannot reduce the quality of the work performed by the press by actuating the foot switch 160 after the power stroke has begun. At any time before initiation of the power stroke, the actuation of the foot switch 160 will abort the cycle without injury to the toggle mechanism assembly 26. The abortion of the cycle is accomplished by removing one's foot from the foot switch valve 160 which opens the foot switch valve providing pressurized air through valve 180 to the bottom of the cylinder to raise the ram 64. After the cylinder 74 pivots sufficiently to close valve 181 the cycle can not be aborted.

When pressurized air is supplied to the cylinder 74, to extend the rod 72 to the left, the cylinder 74 pivots counterclockwise about the pin 99, compare FIGS. 4 and 5, whereupon the bracket 179 moves away from the valves 180 and 181, FIG. 2, permitting the valve 181 to open and closing valve 180. The opening of valve 181 provides pressurized air to the top of the piston within cylinder 82, this force being transferred to the ram 64 through the rod 80 and arm 84. The valve 180 is so constructed that when it closes it permits the air below the piston to exhaust. This provides a clamping force on the ram 64 holding it in position to receive the pin 60 of the lower toggle link 52 as the pin 60 swings to the left, FIG. 5, in the notch 62.

When pressurized air is supplied to the cylinder 74 to reflect the rod 72 to the right, the cylinder 74 pivots clockwise about pin 99, compare FIGS. 5 and 4, whereupon the bracket 179 moves toward the valves 180 and 181, FIG. 2, closing valve 181 and permitting valve 180 to open.

The opening of valve 180 provides pressurized air to the bottom of the piston within the cylinder 82, causing the rod 80 to raise. The valve 181 is so constructed that when it closes it permits the air above the piston to exhaust.

It is seen by comparing FIGS. 4 and 5 that the ram 64 travels through a substantial distance, in one embodiment about 3 inches, essentially under the force of gravity. As soon as it engages the ball 90 and opens the valve 96, the toggle links 50 and 52 are moved to the left, compare FIGS. 4 and 5, to place the pin 60 into the notch 62 of the ram 64. After the pin 60 becomes seated in the notch 62 and the toggle links 50 and 52 continue to straighten due to the continued movement of the rod 72 to the left a force sufficiently high to install the fastener 28 is available at the ram 64.

It is a feature of this invention that such force is available only for a very short distance of travel of the punch 24. In one embodiment this short distance is 7/32 of an inch between the face of the punch and the top of the anvil. Since a hand or finger is thicker than 7/32 of an inch it is seen that the nose 86 will be prevented from engaging the ball 90 and the pin 60 will not be moved into the notch 62 so that the high force is not applied to the ram 64 at such time.

After the pin 60 initially seats itself in the notch 62, the nose 86 rides along the ball 90 for about 7/32 of an inch to assure that the valve 96 is kept open at such time.

After the punch 24 contacts the fastener 28 and the punch 24 continues its downward movement due to the fact that the rod 72 continues to move to the left to straighten the toggle links 50 and 52. At such time the punch 24 exerts its maximum force upon the fastener 28 but it is understood that this maximum force is exerted and required for about 0.030 to 0.050 of an inch, the approximate distances that various fasteners are embedded into the plate 30.

During the time of maximum force exertion, the roof 18 of the frame 12 tends to deflect or spring upwardly. The combination of this deflection and the tolerances in the parts are adjusted for at the punch holder.

Preferably, the toggle links 50 and 52 are prevented from going to their fully extended vertical position so as to not lock up the toggle in a dead center position. This is accomplished by adjusting the connection of the clevis 70 to the rod 72 so that when the piston (not shown) within the cylinder 74 bottoms out, i.e., moves to the left (FIG. 5) its maximum amount, the toggle pin 54 is to the right (by the desired distance) of the full vertical position of the toggle links 50 and 52.

While this invention has been described as incorporating pneumatic cylinders and pistons it will be understood that other types of pneumatic devices, such as bellows, could be used instead.

Having described this invention, it is claimed:

1. A press for assembling a fastener or the like to a plate or the like comprising a frame, an anvil assembly carried by said frame, a toggle mechanism assembly carried by said frame and including two toggle links movable between retracted and extended positions, a ram operatively connectable to said toggle links, said toggle mechanism assembly when in said extended position being in contact with said ram and when said toggle mechanism assembly is in said retracted position being out of contact with said ram, punch means connected to said ram, pneumatic means for retracting and extending said toggle links and applying a force to said ram when one of said toggle links is in contact with said ram, said pneumatic means including a first pneumatic cylinder and piston assembly for holding said ram in a raised position, first pneumatic switch means for terminating the flow of pressurized air to said first pneumatic cylinder, thereby permitting said ram and punch means to descend by gravity to a lower position, second pneumatic switch means activated after a sufficient descent of said ram and punch means toward said lower position, and a second pneumatic cylinder piston and assembly operatively connected to said second pneumatic switch means for extending and retracting said toggle links, whereby when said toggle links are extended and one of said toggle links is in contact with said ram a force sufficiently high to insert said fastener into said plate is applied by said toggle links to said ram and when said toggle links are retracted and one of said toggle links is out of contact with said ram no force is applied by said toggle links to said ram and said ram is permitted to descend and rise without contacting said toggle mechanism assembly.

2. A press for assembling a fastener or the like to a plate or the like comprising a frame, an anvil, ram and punch means movable downwardly from a raised position to a lowered position with a force that is low enough not to injure a finger or hand which may obstruct movement thereof, the distance between said punch means and said anvil when said ram and punch means is in its lowered position being less than the thickness of an adult hand or finger, first means for moving said ram and punch means back and forth between said raised and lower positions, a toggle comprising two toggle links, said toggle links being pivotally connected to each other at the middle of said toggle, a first end of said toggle being operatively mounted on said frame, a second end of said toggle being free to pivot back and forth toward and away from said ram and punch means, and second means for extending said toggle and retracting said toggle so as to join said second end of said toggle with said ram and punch means in force transmitting relationship after said ram and punch means is in its lowered position, whereby the high forces required to install the fastener into the plate is applied by said punch means over a distance which is less than the thickness of an adult hand or finger, thus maximizing the safe operation of the press.

3. The combination of claim 2 and further including a plate means secured to said frame, the first end of said toggle being mounted on a pin carried by said plate means, said first means for moving said ram and punch means being mounted to said plate means, said second means for extending and retracting said toggle being also carried by said plate means, whereby removal of said plate means from said frame also removes said toggle, said first means and said second means.

4. The combination of claims 2 or 3 in which said second means is pneumatically operated.

5. A press for assembling a fastener or the like to a plate or the like comprising a frame;

an anvil carried by said frame;

a force transmitting linkage mechanism carried by said frame and including at least two links;

a ram means operatively connectable to and disconnectable from said linkage mechanism;

said force transmitting linkage mechanism being movable into force transmitting contact with said ram means and also being movable out of force transmitting contact with said ram means, first actuating means for moving said ram means back and forth between raised and lowered positions; and second actuating means for moving said force transmitting linkage mechanism into force transmitting relationship with said ram means after said ram means has descended from the raised position to a lower position, for extending said linkage mechanism into force transmitting relationship with said ram means, for moving said ram means into a lowered position, and for thereafter retracting said linkage mechanism from said ram means to permit said first actuating means to return said ram means to the raised position.

6. A press for assembling a fastener or the like to a plate or the like comprising a frame, an anvil assembly carried by said frame, a toggle mechanism assembly carried by said frame and including two toggle links, a ram operatively connectable to said toggle links, punch means connected to said ram, pneumatic means for retracting and extending said toggle links and applying a force to said ram, said pneumatic means including a first pneumatic cylinder and piston assembly for holding said ram in a raised position, first pneumatic switch means for terminating the flow of pressurized air to said first pneumatic cylinder, thereby permitting said ram and punch means to descend by gravity to a lower position, second pneumatic switch means activated after a sufficient descent of said ram and punch means toward said lower position, and a second pneumatic cylinder piston and assembly operatively connected to said second pneumatic switch means for extending and retracting said toggle links, whereby when said toggle links are extended a force sufficiently high to insert said fastener into said plate is applied by said toggle links to said ram, one of the two toggle links is operatively pivoted at one end thereof to said frame, the two toggle links are pivotally connected to each other and operatively connected to said second pneumatic cylinder piston assembly, the other of said two toggle links carrying a pin at the end thereof opposite the pivotal cnnection between said toggle links, and said ram having a portion adapted to receive said pin in force transmitting relation with said toggle mechanism after said ram descends to its lower position and removable from said force transmitting relationship upon retraction of said toggle links.

7. The combination set forth in claim 1 wherein said first pneumatic cylinder and piston assembly further includes a rod and an arm, said arm being connected to said ram for joint movement therewith, said arm actuating said second switch means after a sufficient descent of said ram and punch means, and said pneumatic means also including valve means connected to said second pneumatic cylinder and piston assembly to extend and retract said toggle links.

8. A press for assembling a fastener or the like to a plate or the like comprising a frame;

an anvil carried by said frame;

a force transmitting linkage mechanism carried by said frame and including at least two links;

a ram means operatively connectable to said linkage mechanism;

first actuating means for moving said ram means back and forth between raised and lowered positions;

second actuating means for moving said force transmitting linkage mechanism into force transmitting relationship with said ram means after said ram means has descended from the raised position to the lowered position by said first actuating means, for extending said linkage mechanism in force transmitting relationship with said ram means to move said ram means into the lowered position, and thereafter for retracting said linkage mechanism from said ram means to permit said first actuating means to return said ram means to said raised position, said ram means including a force receiving member, said linkage mechanism including a force delivering link, and said force receiving member and said force delivering link being coupled together only after said ram means has moved to its lowered position and uncoupled from each other before said ram means is returned to its raised position.

9. The combination of claim 8 wherein said ram means is movable back and forth from a raised position to a lowered position with a force that is low enough not to injure a finger or hand which may obstruct downward movement thereof, the distance between said ram means and said anvil when said ram means is in its lowered position being less than the thickness of an adult hand or finger, said two links being pivotally connected to each other and operatively mounted on said frame with one end of one of said links being free to pivot back and forth toward and away from said ram means and into and out of operative connection therewith, said second actuating means pivoting said force transmitting linkage mechanism into a position operatively connecting said one end of one link with said ram means in a force transmitting relationship but only after said ram means has moved to its lowered position, lowering said ram means while applying to said ram means a force sufficiently high to install said fastener into said plate, and thereafter operationally disconnecting said one end of said link from said ram means so that said first actuating means may return said ram means to its raised position, whereby the high force required to install the fastener into the plate is applied by said ram means over a distance which is less than the thickness of an adult hand or finger, thus maximizing the safe operation of the press.

* * * * *